United States Patent [19]

Terada et al.

[11] Patent Number: 4,600,676

[45] Date of Patent: Jul. 15, 1986

[54] TONER COMPOSITION CONTAINING TITANATE COUPLING AGENT FOR ELECTROPHOTOGRAPHY AND METHOD FOR PRODUCING SAID TONER

[76] Inventors: Sadatugu Terada; Kiyoshi Tamaki; Hideki Murata; Akitoshi Matsubara, all of c/o Konishiroku Photo Ind. Co., Ltd., 1,, Sakura-machi, Hino-shi, Tokyo; Tsuneo Wada; Hiroyuki Takagiwa, both of c/o Konishiroku Photo Ind. Co., Ltd., 2970 Ishikawa-cho, Hachioji-shi, Tokyo, all of Japan

[21] Appl. No.: 641,348

[22] Filed: Aug. 15, 1984

Related U.S. Application Data

[63] Continuation of Ser. No. 496,672, May 23, 1983, abandoned, which is a continuation-in-part of Ser. No. 312,395, Oct. 19, 1981, abandoned.

[30] Foreign Application Priority Data

Nov. 10, 1980 [JP] Japan ..... 55-156911

[51] Int. Cl.[4] ..... G03G 9/08

[52] U.S. Cl. ..... 430/106.6; 430/110; 430/137

[58] Field of Search ..... 430/137, 106.6, 110; 523/216; 524/790, 783; 106/308

[56] References Cited

U.S. PATENT DOCUMENTS

| | | | |
|---|---|---|---|
| 4,098,758 | 7/1978 | Monte et al. | 523/216 |
| 4,122,062 | 10/1978 | Monte et al. | 260/42.14 |
| 4,148,741 | 4/1979 | Bayley | 430/137 |
| 4,163,004 | 7/1979 | Erickson et al. | 523/216 |
| 4,303,749 | 12/1981 | Gruber et al. | 430/107 |

*Primary Examiner*—John L. Goodrow

*Attorney, Agent, or Firm*—Frishauf, Holtz, Goodman & Woodward

[57] ABSTRACT

A toner composition in particle form for electrophotography comprising an inorganic material powder, e.g., a magnetic material, which is dispersed together with other additives in a binder resin toner composed of a polymer obtained by polymerizing a polymerizable monomer, e.g., a vinyl monomer, in the presence of a titanate coupling agent.

17 Claims, No Drawings

TONER COMPOSITION CONTAINING TITANATE COUPLING AGENT FOR ELECTROPHOTOGRAPHY AND METHOD FOR PRODUCING SAID TONER

This application is a continuation of application Ser. No. 496,672, filed May 23, 1983, now abandoned which in turn is a continuation-in-part of Ser. No. 312,395 filed Oct. 19, 1981, now abandoned.

The present invention relates to a toner for use in developing electrostatically charged images obtained in processes such as electrophotographic process, electrostatic recording processes, electrostatic printing processes and to the method for the production thereof.

In the electrophotographic process, as developers for use in developing the electrostatically charged image formed on a charge retaining member, such as a photoconductive member there have been developers known as "two-component developer" composed of a toner and carrier, and those known as a "one-component developer" composed of a magnetic toner containing a magnetic material but not containing any carrier.

The two-component developer develops an electrostatically charged image in such a way that the toner and the carrier contained therein are rubbed by stirring with each other to be charged to different polarities from each other, and the thus charged toner is brought into contact with the surface of the charge retaining member, and the toner is then attached to the surface by the electrostatic attraction, whereby the electrostatically charged image is developed.

However, the two-component developer has a vital defect in that the carrier thereof becomes gradually fatigued as the development is repeated a number of times and the toner alone is consumed during the repetitive developments, so that the toner concentration in the developer becomes decreased, and therefore, in order to maintain the development in good conditions in successive copying operations, appropriate replenishment of the toner must be made to keep a given mixing proportion with the carrier.

To remove such a defect, the one-component developer composed of toner alone but not containing any carrier has been proposed. The magnetic toner constituting the one-component developer is one that develops electrostatically charged images by the developing method called the "magnetic brush method", in which the magnetic toner is caused to ear up in the brush form on the sleeve in the developing means by the action of magnetism, and the ear-formed toner is brought into contact with the surface of the charge retaining member.

In detail, there is, for example, the so-called "conductive magnetic toner" disclosed in U.S. Pat. No. 3,639,245 describing the combination composition of ferromagnetic material particles such as triiron tetraoxide, thermoplastic resin such as epoxy resin, and conductive carbon black. Although this conductive magnetic toner is free from said defect of the two-component developer, the conductivity thereof hinders the obtaining of a satisfactory image quality by disturbing partially or entirely the image at the time of transferring onto a plain paper the toner image developed with the foregoing magnetic toner by transfer means of the most common and readily controllable corona discharger.

In order to solve this problem, it has been proposed to use an insulating magnetic toner as disclosed in, for example, Japanese Patent Publication Open to Public Inspection (hereinafter referred to as Japanese Patent O.P.I. Publication) No. 45639/1975, No. 26049/1975 and No. 67330/1977, and British Patent No. 1481332 which describe insulating magnetic toners whose volume resistivity is $10^{13}\Omega$.cm or more and which are capable of making image transfer by means of a corona discharger and of transferring the image onto a plain paper.

The insulating magnetic toner, however, requires that the toner contain a considerable amount of a magnetic material powder and therefore the dispersibility thereof into the binder resin component of the toner is small, so that there is difficulty in the production of the toner. Furthermore, because of the small bonding strength between the magnetic material powder and the binder resin, the toner tends to be crushed at the interface between the magnetic material and the binder resin at the time of the pulverization in the production process of the toner, so that the magnetic material powder particles appear on the surface of the toner particles, but due to the hydrophilicity of the magnetic material, the toner particles are prone to absorb moisture, thus causing the decrease in the moisture resistivity of the toner. Meanwhile when a frictional charging takes place on the sleeve of the developing means, a frictional charge arises between the binder resin and the magnetic material powder particles of the toner, so that the charged quantity becomes unstable. In addition, the frictional charge causes the toner particles charged to one polarity to be present together with those charged to the other, and then these toner particles electrostatically adhere to one another, whereby the toner becomes extremely lacking in fluidity.

The elimination or diminishing of the above-described disadvantages may possibly be attained effectively by coating the surface of the magnetic material powder particles with an appropriate coating material, and Japanese Patent O.P.I. Publication No. 122129/1979, No. 130130/1979, No. 6344/1980 and No. 11218/1980 describe the improvement in the characteristics of the toner by coating the magnetic material powder particles. And Japanese Patent O.P.I. Publication No. 8473/1979 describes the use of magnetic material powder particles treated with a silane coupling agent while Japanese Patent O.P.I. Publications No. 26519/1980 and No. 28019/1980 describe the use of magnetic material powder particles treated with a titanate coupling agent.

However, these surface treatments of magnetic material powder particles by such conventional techniques may be effective to make up for a part of the above-described disadvantages, but are far from solving all of them, and to the extent that they might be practically useful, the use would be in only a limited range and the resulting effect may not be worth appreciating.

For example, where magnetic material powder particles whose surface is coated with a resin are used, in the process for kneading with the binder resin, the viscosity of the said binder resin becomes increased, so that the process requires the use of a solvent and the kneading is at a higher temperature which exert a bad influence upon the characteristics of the binder resin, thus causing the toner particles to cohere and to tend to decrease in the aging stability thereof. And also when using magnetic material powder particles surface-treated with a titanate coupling agent, it is difficult to uniformly disperse the magnetic material powder into the binder resin at the time of kneading therwith.

The present invention has been accomplished as a result of devoting ourselves to studying, taking into account the above-described situation, on a toner composition of this kind along with looking into the cause which has not been effectively solved by the conventional art.

It is an object of the present invention to provide a toner composition wherein a magnetic material and other inorganic material powder particles are satisfactorily dispersed in the toner binder resin particles body, thus having satisfactory characteristics.

It is another object of the present invention to provide a toner composition whose particles contain inorganic material powder, said toner being excellent in the moisture resistance even when said inorganic material powder is hygroscopic.

It is a further object of the present invention to provide a toner composition whose characteristics are stably maintainable over an extended period of time.

In the present invention, the toner composition is produced in such a way that an inorganic material powder is dispersedly incorporated together with a required coloring agent and other additives into a binder resin toner particles composed of a polymer obtained by polymerizing a polymerizable monomer in the presence of a titanate coupling agent.

The method for the production of the toner of the present invention is illustrated in detail: into a polymerizable monomer are dispersedly mixed or dissolved a titanate coupling agent and an inorganic material powder together with a required coloring agent and other additives to obtain a composition to be polymerized, and the composition is then polymerized or the thus polymerized solid is further pulverized, whereby particles with the particle diameter (normally from 1 to 50 microns) required as toner are obtained, thus producing a toner composition.

Polymerization of the above-described polymerization composition may be carried out using various polymerization method such as suspension polymerization, block polymerization, emulsion polymerization, solution polymerization and the like. In the polymerization, when the use of a polymerization initiator or catalyst is necessary it may be in advance added to the said polymerization composition.

Alternatively, there may also be used such a manner that a polymerization composition containing a titanate coupling agent is prepared and polymerized, and to the resulting polymer is added the inorganic material powder to be fused and kneaded, and the thus obtained lump pulverized. In this case, a coloring agent and other additives may be either in advance incorporated into or added together with the inorganic material powder to the polymerization composition.

Further, by adequately selecting a polymerization method and the condition thereof a polymer having the required particle diameter may be directly obtained, in which case the incorporation of the titanate coupling agent, coloring agent and other materials required as the components of the toner into the foregoing polymerization composition provides the desired toner comprising globular particles having high fluidity in a substantially single process. In this case, the suspension polymerization method is normally employed. In the suspension polymerization method, the polymerization composition is subjected to mechanical agitation to form dispersed particles with the required particle diameter suspended in a suspension medium such as water, thereby carrying out the polymerization, but in this case, the viscosity of the dispersed particles increases as the polymerization goes on, whereby they are united to become larger in particle size, and therefore a suspension stabilizer is needed to be added to prevent this tendency.

Those used as suspension stabilizers are generally classified as water-soluble polymer and less-soluble inorganic compounds in the powder form, the former including gelatin, starch, polyvinyl alcohol and the like, while the latter including such less-soluble salts as barium sulfate, calcium sulfate, barium carbonate, calcium carbonate, calcium phosphate and the like; such inorganic polymer as talc, clay, silicic acid, diatom earth and the like; and metallic oxides and other powder materials. And in the case where the polymerization composition containing an ionic material, e.g., a cationic or anionic material such as nitrogen-containing polymerizable monomers or waterless-soluble amines is dispersed into water, when the dispersed particles are charged to either positive or negative polarity due to the containing of such ionic materials, an ionic dispersing agent which is charged to the opposite polarity thereto, for example, negatively chargeable colloidal silica or positively chargeable aluminum oxide may be effectively used as a suspension stabilizer.

Meanwhile, in the suspension polymerization, the agitation of the suspension system is an important element which affects the particle size of the polymer as well as the stability of the polymerization; to obtain polymer particle diameter in the range of from 1 to 50 microns, although it varies according to the viscosity of the polymerization composition, interfacial tension, etc., an agitation of the shearing stress of from $10^3$ to $10^6$ dyne/cm$^2$ should be made.

Preferred titanate coupling agents usable in the present invention are those having the formulas [I] to [V]:

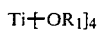

Formula [I]

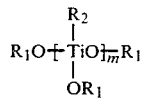

Formula [II]

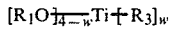

Formula [III]

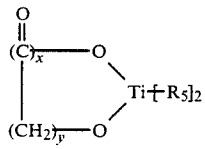

Formula [IV]

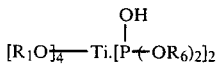

Formula [V]

wherein the groups $R_1$ may be the same or different and are selected from an alkyl group, an aryl group, or an aralkyl group having from one to 18 carbon atoms which may have a substituent or substituents; $R_2$ is $-OR_1$ or $-OOCR_1$ (wherein $R_1$ follows the above definition); $R_3$ is $-OOCR_1$, $-SO_3R_1$,

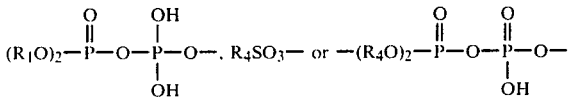

(wherein $R_1$ follows the above definition); $R_5$ has the same definition as $R_1$ or as $R_3$; $R_6$ has the same definition as $R_1$ or is an aryl group which may or an aryl group which may have a substituent or substituents; m is from 2 to 20; w is from 1 to 3; x is zero or 1; and y is from 1 to 3.

Examples of those compounds having the above formulas follow: Exemplified compounds:

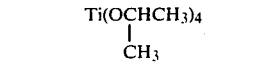

(1)

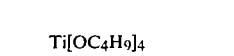

(2)

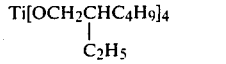

(3)

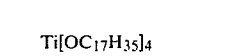

(4)

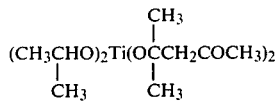

(5)

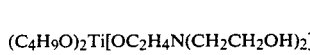

(6)

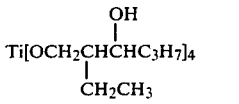

(7)

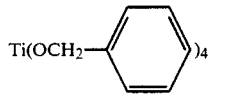

(8)

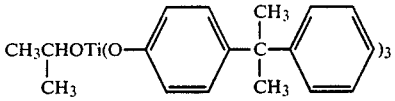

(9)

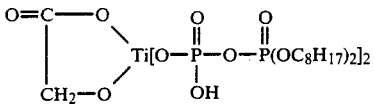

(10)

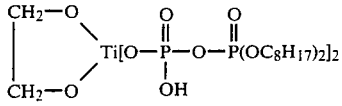

(11)

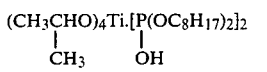

(12)

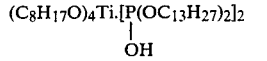

(13)

-continued

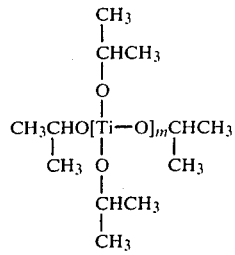

(14)

$\bar{m} = 10$

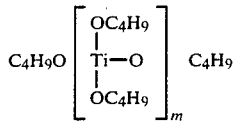

(15)

$\bar{m} = 4, 7, 10$

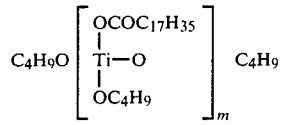

(16)

$\bar{m} = 4$

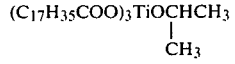

(17)

(18)

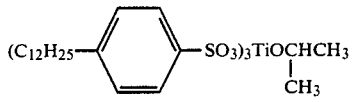

(19)

(20)

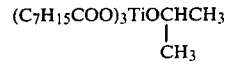

(21)

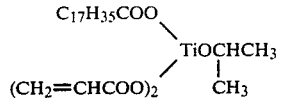

(22)

In the above, $\bar{m}$ represents the average degree of polymerization.

The titanate coupling agents shown in the above examples are generally available from the market, less expensive than silane coupling agents, and well reactive, so that they may be advantageously used. Those commercially available include, for example, a series of the products "PURENAKUTO" TTS, 9S, 38S, 41B, 46B, 55, 138S, and the like manufactured by Ajinomoto Co., Inc.; the organic titanium products "A-1" (TPT), "B-1" (TBT), "TOT", "TST", "TAA", "TAT", "TLA" (Tilac), "TOG", "TBSTA", "A-10" (polymer of "TPT"), "B-2" the polymer of "TBT", "B-4", "B-7", "B-10", "TBSTA-400" (polymer of "TBSTA"), "TTS", "TOA-30", "TSDMA", "TTAB", "TTOP", and the like manufactured by Nippon Soda Co., Ltd. Adding quantities of the above-described titanate coupling agents should be in the range of from 0.01 to 10% by weight, preferably from 0.05 to 5% by weight to the monomer to provide the binder resin applied.

As the monomer to provide polymers as the binder resin of the present invention there may be used arbitrary polymerizable monomers, which may be self-polymerizable vinyl monomers, or may be, for example, such monomers as dibasic acids, glycol and the like from which polyester resin may be produced, but above all vinyl monomers are preferred.

Examples of polymerizable monomers usable in the present invention include styrenes such as, for example, styrene, o-methyl styrene, m-methyl styrene, p-methyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-phenyl styrene, p-chlorostyrene, 3,4-dichlorostyrene, and the like, and of these styrene monomer is most preferred; ethylene unsaturated monoolefins such as, e.g., ethylene, propylene, butylene, isobutylene and the like; halogenated vinyls such as vinyl chloride, vinylidene chloride, vinyl bromide, vinyl fluoride and the like; vinyl esters such as vinyl acetate, vinyl propionate, vinyl benzoate, vinyl butyrate and the like; α-methylenealiphatic monocarboxylic acid esters such as methyl acrylate, ethyl acrylate, n-butyl acrylate, isobutyl acrylate, propyl acrylate, n-octyl acrylate, dodecyl acrylate, 2-ethyl hexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate, diethylaminoethyl methacrylate, and the like; acrylic or methacrylic acid derivatives such as acrylonitrile, methacrylonitrile, acrylamide, and the like; vinyl ethers such as vinyl methyl ether, vinyl ethyl ether, vinyl isobutyl ether, and the like; vinyl ketones such as vinyl methyl ketone, vinyl hexyl ketone, methyl isopropenyl ketone, and the like; N-vinyl compounds such as N-vinyl pyrrole, N-vinyl carbazole, N-vinyl indole, N-vinyl pyrolidone, and the like; and vinyl naphthalenes.

These vinyl monomers may be used in single or in combination of a plurality of monomers to produce copolymers.

The monomer to provide polyester resins include dibasic acids such as terephthalic acid, isophthalic acid, adipic acid, maleic acid, succinic acid, sebacic acid, thioglycolic acid, diglycolic acid, and the like; glycols such as ethylene glycol, diethylene glycol, 1,4-bis-(2-hydroxyethyl)benzene, 1,4-cyclohexane dimethanol, propylene glycol, and the like.

The monomer to provide polyamide resins include caprolactam; dibasic acids such as terephthalic acid, isophthalic acid, adipic acid, maleic acid, succinic acid, sebacic acid, thioglycolic acid, and the like; and diamines such as ethylenediamine, diaminoethyl ether, 1,4-diaminobenzene, 1,4-diaminobutane, and the like.

The monomer to provide polyurethane resins include diisocyanates such as p-phenylenediisocyanate, p-xylylenediisocyanate, 1,4-tetramethylenediisocyanate, and the like; and glycols such as ethylene glycol, diethylene glycol, propylene glycol, polyethylene glycol and the like.

The monomer to provide polyurea resins include diisocyanates such as p-phenylenediisocyanate, p-xylylenediisocyanate, 1,4-tetramethylenediisocyanate, and the like; and diamines such as ethylenediamine, diaminoethyl ether, 1,4-diaminobenzene, 1,4-diaminobutane, and the like.

The monomer to provide epoxy resins include amines such as ethylamine, butylamine, ethylenediamine, 1,4-diaminobenzene, 1,4-diaminobutane, monoethanolamine, and the like; and diepoxys such as diglycyzyl ether, ethylene glycol diglycyzyl ether, bisphenol A diglycyzyl ether, hydroquinone diglycyzyl ether, and the like.

The above-enumerated monomers may be used alone and also in a variety of combinations of self-polymerizable monomers and other monomers.

Those polymers obtained from the above polymerizable monomers are allowed to be bridge-structured polymers. The bridge-structured polymer may be those produced from self-bridge-formable monomers just as prepolymers are (in this case, self-bridge-formable monomers may be used together with different monomers), and may also be those bridge-structured polymers produced by the bridge-forming agent which has been present at the time of the polymerization of monomers.

As such a bridge-forming agent, any known material may be used if it is capable of bridge-polymerizing the monomer used, but it is preferred to be a compound having at least two polymerizable vinyl groups.

In detail, all divinyl compounds and compounds having three or more vinyl groups may be used in single or in combination of two or more kinds: such compounds including aromatic divinyl compounds such as divinyl benzene, divinyl naphthalene, and the derivatives of these compounds; diethylenic unsaturated carboxylic acid esters such as ethylene glycol dimethacrylate, diethylene glycol dimethacrylate, triethylene glycol dimethacrylate, trimethylolpropane triacrylate, allyl methacrylate, t-butylaminoethyl methacrylate, tetraethylene glycol dimethacrylate, 1,3-butanediol dimethacrylate, and the like; N,N-divinyl aniline, divinyl ether, divinyl sulfide, divinyl sulfone, and the like.

Further, there may be used as bridge-forming agents the following compounds: dihydric alcohols such as ethylene glycol, triethylene glycol, 1,2-propylene glycol, 1,3-propylene glycol, 1,4-butane diol, neopentyl glycol, 1,4-butene diol, 1,4-bis(hydroxyethyl)cyclohexane, bisphenol A, hydrogenated bisphenol A, polyoxyethylenated bisphenol A, polyoxy-propylenated bisphenol A, and the like; dibasic acids and the derivatives thereof such as maleic acid, fumaric acid, mesaconic acid, citraconic acid, itaconic acid, glutaconic acid, phthalic acid, isophthalic acid, terephthalic acid, cyclohexane-dicarboxylic acid, succinic acid, adipic acid, sebacinic acid, malonic acid, anhydrides of these acids, or esters of these acids with lower alcohols; trihydric or polyhydric alcohols such as glycerol, trimethylolpropane, pentaerythritol, and the like; and trihydric or polyhydric carboxylic acids such as trimellitic acid, pyromellitic acid and the like.

The adding amount of such bridge-forming agents to monomers is selected in the range of from 0.005 to 20% by weight, preferably from 0.1 to 5% by weight. If the adding amount is excessive the agent becomes insoluble or infusible, and the fixability of the resulting toner tends to become insufficient, while if the amount is too small, then the toner becomes lacking in such characteristics as the durability, storeability, wear resistance, and the like.

In addition, such polymers as the binder resin in the present invention are those obtained by the polymerization of monomers in the presence of a titanate coupling agent, but at the time of the polymerization an initiator may of course be used. As the polymerization initiator there may be used, for example, lauroyl peroxide, benzoyl peroxide, 2,2'-azobisisobutylonitrile, 2,2'-azobis-(2,4-dimethyl valeronitrile), benzoyl orthochlor peroxide, benzoyl orthomethoxy peroxide, and the like.

The polymer used in the present invention is desired to have a softening point in the range of from 100° to 170° C. in accordance with the ring and ball method and a glass transition point in the range of from 40° to 110° C. If the softening point is below 100° C., when the production process includes pulverization, the toner tends to be excessively pulverized, resulting in the toner filming phenomenon on the charge retaining member, so that stains tend to appear on the surface of the charge retaining member, while if the softening point exceeds 170° C., the polymer is hardly pulverized because of the hardness thereof and in addition the fixing efficiency is lowered because a large amount of heat is required at the time of the fixation.

On the other hand, when the glass transition point is less than 40° C., because the normal storage condition of the toner is below 40° C., the toner is prone to become lumped due to the cold flow phenomenon. When the glass transition point exceeds 110° C., there are drawbacks that sufficient fixation cannot be carried out particularly in the high-speed fixing operation because of the restriction that excessively high temperature cannot be applied to the fixation due to the limit of the heat resistance of the material constituting the roller for use in the fixation on the ground that a high temperature is required in the case of fixing by means of heat rollers, so that, aside from where the roller is made of metal, such rollers as made of, e.g., Teflon (polytetrafluoroethylene, manufactured by Du Pont) tend to become worn off or begin to decompose at temperatures of above 250° C., and furthermore if the fixation is carried out at an extremely high temperature, there may possibly occur such a trouble that the paper or the toner imagebearing support becomes charred or begins to burn.

In the present invention, as has been mentioned, an inorganic material powder is incorporated by dispersing into the toner particles composed of a polymer polymerized in the presence of a titanate coupling agent. As an example of the inorganic material powder there is a magnetic material powder, which may be incorporated by dispersing into the toner particles, whereby the magnetic toner may be obtained. Another example of such inorganic material powder is silica powder, and the incorporation by dispersion of the powder enables to obtain toner having a large fluidity. The use of other different inorganic material powders may of course be allowed; for example, inorganic pigments.

This inorganic material powder is incorporated into a polymer obtained by mixing with a titanate coupling agent into a polymerizable monomer, but may also be dispersedly incorporated by kneading into the polymer after the polymerization of the polymerizable monomer containing the titanate coupling agent.

In the present invention, the magnetic material used as an inorganic material powder is preferred to be a material that is strongly magnetized by the magnetic field in the direction thereof, preferably is black, and is readily dispersible into the resin to become chemically stable, and besides, capable of being readily obtainable in the form of particles of less than one micron in diameter. From this point of view, magnetite (triiron tetraoxide) is most preferred.

Such magnetic materials or magnetizable materials are typified by metals such as cobalt, iron, and nickel; alloys of metals and the mixtures thereof such as aluminum, cobalt, copper, iron, lead, magnesium, nickel, tin, zinc, antimony, beryllium, bismuth, cadmium, calcium, manganese, selenium, titanium, tungsten, and vanadium; metallic compounds containing metal oxides such as aluminum oxide, iron oxide, copper oxide, nickel oxide, zinc oxide, titanium oxide, and magnesium oxide; refractory nitrides such as vanadium nitride, chromium nitride; carbides such as tungsten carbide, silica carbide; ferrite; and mixtures of these materials. These ferromagnetic materials are preferred to be in the average particle diameter of from approximately 0.1 to 1.0 micron, and the amount thereof to be contained in the toner particles body is desirable to be from about 50 to about 300 parts by weight, most preferably from 90 to 200 parts by weight per 100 parts by weight of the resin component.

The inorganic pigments include, for example, titanium oxide, silicon dioxide, zinc white, white lead, clay, gypsum, carbon black, graphite, black iron, iron oxide red, minium, aluminum powder, brass powder, calcium tungstate, and the like.

The average particle diameter of the toner of the present invention is the same as that of commonly used toners, preferably in the range of from 7 to 30 microns. That the toner contains such particles as larger than 50 microns in diameter is undesirable because it causes stains to appear on the surface of the charge retaining member and decreases the sensitivity as well as the image density of the light-sensitive body.

The present invention, as has been mentioned, is such that the polymer as the binder resin is obtained by polymerizing a polymerizable monomer in the presence of a titanate coupling agent, and into the resulting particles body is dispersedly incorporated an inorganic material powder, so that the generally lipophilic polymer is provided largely by the titanate coupling agent with the affinity to inorganic materials. Furthermore, the titanate coupling agent is present in the polymerization reaction system at the time of the reaction, so that the agent becomes mixedly present in the molecular units throughout the entire polymer formed, or part of the agent becomes coupling with the molecules of the polymer, and hence, the polymer itself becomes in the state of having affinity to the inorganic material, thus fully avoiding such a condition that the coupling agent is separated from the polymer, and therefore the inorganic material powder may be dispersed highly uniformly and stably in the polymer, thus permitting the prevention of the possibility that the inorganic material powder is separated from the polymer to appear on the surface of the particles body or to cohere, thereby permitting to obtain a large moisture resistance and storeability of the toner.

Thus, the toner of the present invention may be provided in the particles system thereof with the uniform and stable characteristics, and further, for this reason, even when various additives are added to the toner, the toner may have the condition that they are stably contained therein.

The above-described effects can be obtained securely and outstandingly particularly when the inorganic material powder is present in the reaction system at the time of the polymerization in the presence of a titanate coupling agent, but can also be sufficiently obtained in the case where the inorganic material powder is kneaded into the polymer after the formation thereof.

And the polymer of the toner in the present invention, because it contains the titanate coupling agent, has a large affinity to inorganic material powders including the magnetic material powder, and hence is capable of giving a stable and excellent image, and further, depending on the kind, capable of providing the effect to improve the fluidity and charge controllability.

To the toner particles of the present invention there may be added such additives as a coloring agent, charge controlling agent, fluidizing agent, surface lubricant and the like. These additives may be present together with the titanate coupling agent in the polymerization reaction system at the time of the polymerization of the monomer, or may be incorporated by kneading into the polymer particles body after obtaining the polymer.

As the coloring agent, those arbitrary ones selected from pigments, dyes and the like may be used; typical examples include, e.g., carbon black, nigrosine dye (C.I. No. 50415B), aniline blue (C.I. No. 50405), chalcoil blue (C.I. No. azoec Blue 3), chrome yellow (C.I. No. 14090), ultramarine blue (C.I. No. 77103), Du Pont oil red (C.I. No. 26105), Orient oil red #330 (C.I. No. 60505), quinonline yellow (C.I. No. 47005), methylene blue chloride (C.I. No. 52015), phthalocyanine blue (C.I. No. 74160), malachite green oxalate (C.I. No. 42000), lumpblack (C.I. No. 77266), rosebengal (C.I. No. 45435), oil-black, azo-oilblack and the like. These pigments and dyes may be used in single or in a mixture thereof. These coloring agents should be contained in the proportion of from about 3 to about 20% by weight in the toner as the finished product, and in the case of incorporating the foregoing magnetic material powder into the toner, the magnetic material powder may also be utilized as part of or the whole of a coloring agent.

The addition of a prepolymer to become a component of the polymer to the toner particles of the present invention enables further improvements in the storeability, moisture resistance, charge characteristics of the toner and such fixability characteristics as the antioffset effect in the roller fixing process.

As the prepolymer described herein, reactive prepolymers are preferred, which are those having a group which can react with the functional group of the monomer that provides the polymer.

These reactive groups are typified by carboxyl group (—COOH), sulfone group ($-SO_3H$), ethyleneimino group

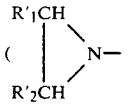

(wherein $R'_1$ and $R'_2$ each represents hydrogen, an alkyl group such as methyl group)], isocyanate group (OCN—), double bonding group (—CH=CH—), an acid anhydride

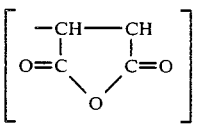

epoxy group

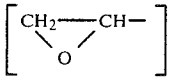

and a halogen, and the like.

The reaction between the reactive group of the foregoing prepolymer and the monomer includes various reaction forms ranging from such a reaction as effected by merely mixing them to that effected in the presence of such a catalyst as a polymerization initiator, and that effected by light irradiation as in the case of cinnamoyl group.

These prepolymer used may be of arbitrary molecular weight, which should be normally 1,000 or more, or further generally from 2,000 to 1,000,000, preferably from 5,000 to 2,000,000.

The following are typical examples of these prepolymers:

(Those having epoxy group)

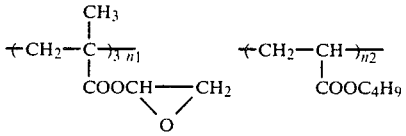

(1)

$(n_1:n_2 = 10:90)$

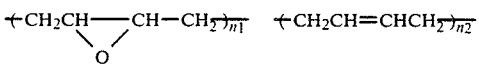

(2)

$(n_1:n_2 = 40:60)$

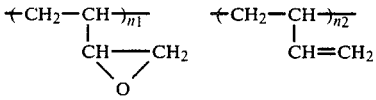

(3)

$(n_1:n_2 = 30:70)$

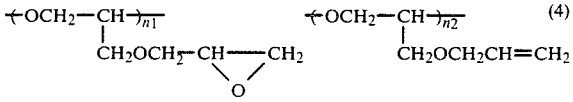

(4)

$(n_1:n_2 = 50:50)$

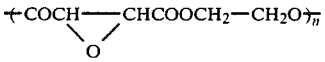

(5)

(Those having ethyleneimino group)

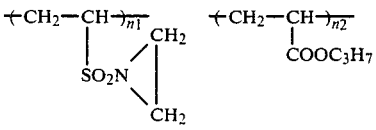

(6)

$(n_1:n_2 = 30:70)$

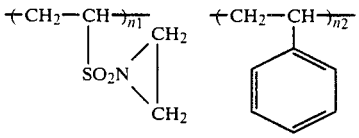

(7)

$(n_1:n_2 = 60:40)$ (One having isocyanate group)

-continued

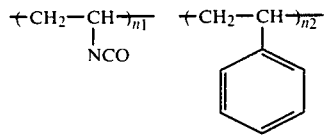

($n_1$:$n_2$ = 20:80)

(Those having double bonding group)

(8) $\leftarrow COCH{=}CHCOOCH_2CH_2O\rightarrow_n$ (9) $\leftarrow CH_2{-}CH\rightarrow_{n1}$ ($COOCH_2CH{=}CH_2$) $\leftarrow CH_2{-}CH_2\rightarrow_{n2}$ ($n_1$:$n_2$ = 60:40)

(10) $\leftarrow OCH_2{-}CH\rightarrow_{n1}$ ($CH_2OCOCH{=}CH_2$) $\leftarrow OCH_2CH_2CH_2CH_2\rightarrow_{n2}$ ($n_1$:$n_2$ = 50:50)

(11) $\leftarrow OCH_2{-}CH\rightarrow_n$ ($CH_2OCH_2CH{=}CH_2$)

(One having acid anhydride group)

(12) $\leftarrow CH_2CH_2CH{-}CH_2\rightarrow_{n1}$ $\leftarrow CH_2CH{=}CHCH_2\rightarrow_{n2}$ ($n_1$:$n_2$ = 60:40)

(Those having carboxyl group)

(13) $\leftarrow CH_2{-}CH\rightarrow_n$ ($COOH$)

(14) $\leftarrow CH_2{-}CH\rightarrow_{n1}$ ($COOC_4H_9$) $\leftarrow CH_2{-}C(CH_3)\rightarrow_{n2}$ ($COOH$)

($n_1$:$n_2$ = 30:70)

(Those having sulfone group)

(15) $\leftarrow CH_2{-}CH\rightarrow_n$ ($SO_3H$)

(16) $\leftarrow CH_2{-}CH\rightarrow_{n1}$ ($COOC_2H_5$) $\leftarrow CH_2{-}C(CH_3)\rightarrow_{n2}$ ($COOCH_2CH_2CH_2SO_3H$)

($n_1$:$n_2$ = 60:40)

(17) $\leftarrow CH_2{-}CH\rightarrow_n$ ($SO_3H$)

(Those bridge-polymerized by means of light)

(18) $\leftarrow CH_2{-}CH\rightarrow_n$ ($O{-}C({=}O){-}CH{=}CH{-}C_6H_4$)

-continued

(19) $\leftarrow C_6H_4{-}OCOCH{=}CH{-}C_6H_4{-}CH{=}CHCOO\rightarrow_n$

In addition to the above, there may also be used butadiene prepolymers such as poly-1,2-butadiene, α-ω-polybutadiene glycol, maleic polybutadiene, terminal acryl denatured polybutadiene and the like.

The adding amount of prepolymers may be used in discretional proportions: preferably from 5 to 95 parts by weight, most preferably from 10 to 70 parts by weight per 100 parts by weight of the monomer used; in the case of less than 5 parts by weight, they may not contribute to the offset preventing effect nor to the improvement in the fixability, while when exceeding 95 parts by weight, there occurs such a trouble that they tend to have excessive blocking property, so that the storeability and fluidity of the toner become deteriorated whereas the offset phenomenon tends to grow.

In the case where the toner image formed by the toner of the present invention is fixed by the roller fixing method (particularly by the use of a heat roller), a surface lubricant may be added to the toner particles for the prevention of the offset phenomenon. As the surface lubricant there are known various kinds, of which those most preferred are lower molecular weight polyolefin.

Such lower molecular weight polyolefin are those polyolefin containing olefins alone as the monomer component thereof or those olefin copolymers containing monomers other than olefins as the monomer component thereof, and are of low molecular weight. The olefin as the monomer component includes all such olefins as, e.g., ethylene, propylene, butene-1, pentene-1, hexene-1, heptene-1, octene-1, nonene-1, decene-1, or homologues of these compounds differing in the unsaturated bonding position, or, for example, those having alkyl groups introduced as the branched chains of 3-methyl-1-butene, 3-methyl-2-pentene, 3-propyl-5-methyl-2-hexene, and the like.

Those monomers other than olefins as the monomer component forming copolymers together with olefins include, for example, vinyl ethers such as, e.g., vinyl methyl ether, vinyl-n-butyl ether, vinyl phenyl ether, and the like; vinyl esters such as, e.g., vinyl acetate, vinyl butyrate, and the like; haloolefins such as, e.g., vinyl fluoride, vinylidene fluoride, tetrafluoroethylene, vinyl chloride, vinylidene chloride, tetrachloroethylene, and the like; acrylates or methacrylates such as, e.g., methyl acrylate, ethyl acrylate, n-butyl acrylate, methyl methacrylate, ethyl methacrylate, n-butyl methacrylate, stearyl methacrylate, N,N-dimethylaminoethyl methacrylate, t-butylaminoethyl methacrylate, and the like; acrylic acid derivatives such as, e.g., acrylonitrile, N,N-dimethyl acrilonitrile, and the like; organic acids such as, e.g., methacrylic acid, maleic acid, fumaric acid, itaconic acid, and the like; and diethyl fumarate, β-pinene, and the like.

Those lower molecular weight polyolefin applicable to the present invention include such polyolefin consisting of olefins alone containing as the monomer components at least two kinds of the above-described olefins as, e.g., ethylene-propylene copolymer, ethylene-butene copolymer, ethylene-pentene copolymer, propylene-butene copolymer, propylene-pentene copolymer, ethylene-3-methyl-1-butene copolymer, ethylene-propylene-butene copolymer, and the like; or such polyolefin containing as the monomer components at least one of the foregoing olefins together with at least one of monomers other than the foregoing olefins as, e.g., ethylene-vinyl acetate copolymer ethylene-vinyl methyl ether copolymer, ethylene-vinyl chloride copolymer, ethylene-methyl acrylate copolymer, ethylene-methyl methacrylate copolymer, ethylene-acrylic acid copolymer, propylene-vinyl acetate copolymer, propylene-vinyl ethyl ether copolymer, propylene-ethyl acrylate copolymer, propylene-methacrylic acid copolymer, butene-vinyl methyl methacrylate copolymer, pentene-vinyl acetate copolymer, hexene-vinyl butyrate copolymer, ethylene-propylene-vinyl acetate copolymer, ethylene-vinyl acetate-vinyl methyl ether copolymer, and the like.

Of the lower molecular weight polyolefin used in the present invention, in those containing as the monomer component thereof monomers other than olefins the olefin component content of the copolymer is desired to be as large as possible because generally the smaller the olefin component content the smaller does the surface bubricity become and the more does such characteristics as the fluidity, image formability, etc., of the toner tend to become deteriorated. Accordingly, the olefin component content of the copolymer is desired to be as large as possible, particularly the olefin content of above about 50 mol% is effectively usable in the present invention.

The molecular weight of the lower molecular weight polyolefin of the present invention should be included in the concept of the lower molecular weight used in the field of general macromolecular compounds: Generally the weight average molecular weight (Mw) is from 1,000 to 45,000.

The lower molecular weight polyolefin of the present invention is desired to have the softening point of from 100° to 180° C., particularly from 130° to 160° C.

The using amount of the lower molecular weight polyolefin of the present invention should be in the range of from 1 to 20 parts by weight, preferably from 3 to 15 parts by weight per 100 parts by weight of the resin component content of the toner; the using amount of less than 1 part by weight may not have any sufficient offset preventing effect, while the amount exceeding 20 parts by weight may sometimes cause gelling during the polymerization.

The toner of the present invention is used for the formation of an image, for example, in the electrophotographic process; that is, there may be used a selenium charge retaining member, a charge retaining member produced by providing a conductive support thereon with a photosensitive layer prepared by dispersedly incorporating into a binder resin such an inorganic photoconductive material such as zinc oxide, cadmium sulfide, cadmium selenate, cadmium sulfide selenate, lead oxide, mercury sulfide, and the like, or a charge retaining member produced by providing a conductive support thereon with a photosensitive layer prepard by incorporating into a binder resin at need an organic photoconductive material such as anthracene, polyvinyl carbazole, and the like, and the entire surface of the photosensitive layer of such a charge retaining member is charged by the corona discharge with the use of a charger such as, e.g., corotron or scorotron charger, and the thus charged photosensitive layer is subsequently imagewise exposed to light or the like to form an electrostatic image thereon, and the resulting electrostatic image is then developed with the use of the toner of the present invention by, e.g., the magnetic brush method to thereby form a toner image. This toner image is then brought into pressure contact under the corona discharge with a sheet of paper to be transferred onto the paper. The toner image thus formed on th paper is thermally fixed by, e.g., a heat roller fixing means the surface of which roller is coated with a fluorine resin having lubricity or with silicone rubber.

Embodiments of the present invention are illustrated in further detail, but the present invention is not limited thereto. In addition, the word "part(s)" means "part(s) by weight" hereinafter unless otherwise stated.

EXAMPLE 1

| | |
|---|---|
| Styrene | 70 parts |
| n-butyl methacrylate | 30 parts |
| Titanate coupling agent "TBSTA-400" (manufactured by Nippon Soda Co., Ltd.) | 2 parts |
| Triiron tetraoxide powder "Mapico Black BL-500" (manufactured by Titanium Industry Co., Ltd.) | 150 parts |
| "Mitsubishi Carbon Black MA-600" (manufactured by Mitsubishi Chemical Industry Co., Ltd.) | 5 parts |

The above materials were mixed at room temperature and then dispersed with stirring spending two hours, and after that into the mixture was dissolved 3 parts of a polymerization initiator 2,2-azobis-(2,4-dimethyl valeronitrile) "V-65" (manufactured by Wako Pure Chemical Industries Ltd.) to thereby obtain a dispersed liquid. The resulting dispersed liquid was added to the 600 parts of 1.25% by weight of aqueous polyvinyl alcohol solution put in a 2-liter separable flask and the mixture was stirred by means of a "TK Homomixer" (manufactured by Tokushu Kika Kogyo Co., Ltd.) at the rate of 3500 r.p.m. The particle diameter of the dispersed particles after 30 minutes was in the range of from 10 to 15 microns. Afterward, the temperature of the system was raised to 60° C. and thereafter the system was stirred by means of a normal stirrer at the rate of 600 r.p.m. for 7 hours during which the polymerization reaction proceeded, whereby a polymerization was carried out. After completion of the polymerization, the solid product was filtered and then dried, thereby obtaining a magnetic toner of the present invention having the average particle diameter of 13 microns.

The thus obtained magnetic toner of the present invention was subjected to a copying test by the use of an electrophotographic copying apparatus having a selenium light-sensitive body, then a reproduced image having a sufficient image density and excellent in the image quality free of fog was obtained with no offset phenomenon found in the fixing thereof.

In addition, the foregoing titanate coupling agent "TBSTA-400" has the following formula:

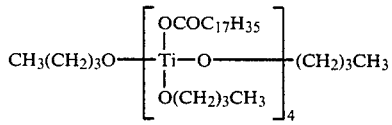

Comparative Example 1

A magnetic toner for comparison was produced in the same manner as in Example 1 with the exception that a silane coupling agent γ-methacryloxypropyl trimethoxysilane "KBM-503" (manufactured by Shin-etsu Chemical Industry Co., Ltd.) was used in place of the titanate coupling agent "TBSTA-400", and the resulting product was subjected to a copying test in a similar manner to that in Example 1, then the obtained reproduced image was found having an insufficient image density with fog, and furthermore an offset phenomenon was found in the fixing.

EXAMPLE 2

| | |
|---|---|
| Styrene | 70 parts |
| n-butyl methacrylate | 30 parts |
| Titanate coupling agent Exemplifed compound (2) "B-1" (manufactured by Nippon Soda Co., Ltd.) | 1.0 part |
| Triiron tetraoxide powder "Mapico Black BL-500" (manufactured by Titanium Industry Co., Ltd.) | 150 parts |
| "Mitsubishi Carbon Black MA-600" (manufactured by Mitsubishi Chemical Industry Co., Ltd.) | 5 parts |
| "Nigrosine Base EX" (manufactured by Orient Chemical Co., Ltd.) | 3 parts |

The above materials were mixed at room temperature, and the mixture was dispersed using a sand stirrer, spending two hours and thereafter into the mixture was dissolved 3 parts of a polymerization initiator 2,2'-azobis-(2,4-dimethyl valero-nitrile) "V-65" to thereby obtain a dispersed liquid. The dispersed liquid was added to 700 parts of a dispersed liquid containing 0.04% by weight of dodecyl benzenesulfonic acid and 0.6% by weight of tricalcium phosphate put in a 2-liter separable flask and the mixture therein was stirred by means of a TK Homomixer at the rate of 3500 r.p.m. The particle diameter of the dispersed particles after 30 minutes was in the range of from 10 to 15 microns. Afterward, the temperature of the system was raised to 60° C., and the system was stirred by means of a normal stirrer at the rate of 450 r.p.m. for 7 hours during which the polymerization reaction proceeded to complete the polymerization. After completion of the polymerization the polymerized product was allowed to cool and treated with a diluted hydrochloric acid to dissolve the tricalcium phosphate, and subsequently the solid product was filtered and then dried, whereby a magnetic toner A of the present invention having the average particle diameter of 13 microns was obtained.

EXAMPLES 3 TO 5

Three magnetic toners B to D of the present invention were produced respectively in the same manner as in Example 2 with the exception that as the titanate coupling agent, 2.0 parts of exemplified compound (11) ("PURENAKUTO 238S", manufactured by Ajinomoto Co., Inc.), 1.5 parts of exemplified compound (14) ("A-10", manufactured by Nippon Soda Co., Ltd.) and 2.0 parts of exemplified compound (19) ("PURENAKUTO 9S", manufactured by Ajinomoto Co., Ind.) were used respectively in place of the exemplified compound (2).

Comparative Example 2

A magnetic toner-E as control was produced in quite the same manner as in Example 2 with the exception that the titanate coupling agent was not used.

Tests were made on the thus produced toners A to E in such manners that the toners were allowed to stand for three days in the atmospheric conditions of such a normal temperture with a normal relative humidity as 20° C. with 60% and such a high temperature with a high relative humidity as 30° C. with 80%, and after that they were subjected to copying tests by use of a copying apparatus made by modifying the electrophotographic copier U-Bix 2000R provided with a zinc oxide photosensitive member (manufactured by Konishiroku Photo Industry Co., Ltd.) for one-component development use, and measurements were made on the maximum image densities and image transfer degrees of the resulting reproduced images. The obtained results are shown in the following table.

TABLE

| | Air Conditions | | | |
|---|---|---|---|---|
| | Normal temperature with Normal humidity | | High temperature with High humidity | |
| | Evaluation | | | |
| Sample | Maximum image density D max | Image transfer degree (%) | Maximum image density D max | Image transfer degree (%) |
| Toner A | 1.26 | 88.3 | 1.05 | 81.4 |
| Toner B | 1.39 | 92.6 | 1.21 | 86.2 |
| Toner C | 1.31 | 90.3 | 1.15 | 83.2 |
| Toner D | 1.35 | 91.8 | 1.18 | 83.7 |
| Control Toner E | 0.82 | 64.5 | 0.40 | 42.3 |

As apparent from the above table, magnetic toners A to D of the present invention show their stable characteristics and the formation of clear images with sufficient densities even in the atmospheric conditions of high temperature with high humidity, whereas toner E as control shows its poor stability and small image transfer degree, and white spots (discharge) appeared conspicuously on the reproduced image, so that any satisfactory copy image was not obtained. The reason for such phenomena is considered due to the fact that when the titanate coupling agent is not applied, the hydrophilic magnetic toner powder appears on the surface of the toner particles, so that the charged quantity is not sufficient and not stabilized.

EXAMPLE 6

| | |
|---|---|
| Styrene | 50 parts |
| n-butyl methacrylate | 30 parts |
| Methyl methacrylate | 20 parts |
| Titanate coupling agent, isopropyl triisostearoyl titanate "TTS" (manufactured by Ajinomoto Co., Inc.) | 1.5 parts |
| Triiron tetraoxide powder "Mapico Black BL-500" (manufactured by Titanium Industry Co., Ltd.) | 150 parts |
| "Mitsubishi Carbon Black MA-100" (manufactured by Mitsubishi Chemical Industry Co., Ltd.) | 5 parts |
| Azobisisobutylonitrile | 3 parts |

The above materials were mixed and dispersed, and the mixture was added to the solution prepared by dissolving 3.3 parts of polyvinyl alcohol into 230 parts of water in a 1-liter separable flask, and the resulting mixture was dispersed for 30 minutes by stirring by means of a TK Homomixer at the rate of 4000 r.p.m., and the temperature of the system was then raised to 70° C., and thereafter was stirred by means of a normal stirrer at the rate of 200 r.p.m. for 6.5 hours during which the polymerization reaction proceeded to carry out the polymerization. After completion of the polymerization, the solid product was filtered and then dried to thereby obtain a magnetic toner of the present invention with the average particle diameter of 12 microns.

Comparative Example 3

Into 50 parts of dried benzene was dissolved 1.5 parts of a titanate coupling agent isopropyl triisostearoyl titanate "TTS" (manufactured by Ajinomoto Co., Inc.), and to this was added 150 parts of triiron tetraoxide powder "Mapico Black BL-500" (manufactured by Titan Industry Co., Ltd.) and then mixed by means of a mixer. The benzene was subsequently distilled off under reduced pressure, and thereafter the product was dried. To the resulting magnetic material powder were added 100 parts of styrene-acryl resin copolymer (the component ratio, styrene:butyl methacrylat:methyl methacrylate = 5:3:2) and 5 parts of "Mitsubishi Carbon Black MA-100" (manufactured by Mitsubishi Chemical Industry Co., Ltd.), and these were subjected to a mixing/dispersing treatment over a period of 10 hours by means of a ball mill. The resulting mixture was milled by a biaxial extruder, cooled and solidified to thereby obtain a lump. This lump was coarsely pulverized, and the pulverized particles body was subjected to a heat treatment by means of a spray dryer with its entrance temperature of 350° C. and exit temperature of 50° C., and was further classified by a zigzag classifier (manufactured by Alpine), whereby a control magnetic toner-3 with the average particle diameter of 15 microns was obtained.

Comparative Example 4

| | |
|---|---|
| Styrene-acryl resin (copolymer of the component ratio, styrene:butyl methacrylate: methyl methacrylate = 5:3:2) | 100 parts |
| Triiron tetraoxide powder "Mapico Black BL-500" (manufactured by Titanium Industry Co., Ltd.) | 150 parts |
| Titanate coupling agent, isopropyl triisostearoyl titanate "TTS" (manufactured by Ajinomoto Co., Inc.) | 2.5 parts |
| "Mitsubishi Carbon Black MA-100" (manufactured by Mitsubishi Chemical Industry Co., Ltd.) | 5 parts |

The above materials were mixed, and after that the same procedures were carried out as in Comparative Example 3 to thereby produce a control magnetic toner-4 with the average particle diameter of 15 microns.

It is understood that Example 6, as compared to Comparative Example 3 and 4, is a very economical method for the production of a toner in respect that it permits not only the production of a toner in an extremely short process but also the obtaining of a toner having a satisfactory particle distribution without through any classifying process.

Each of the magnetic toners obtained in Example 6, Comparative Example 3 and 4 was subjected to copying tests by the application of an electrophotographic copying apparatus U-Bix 2000R provided with a magnetic toner developing means and with a zinc oxide photosensitive member. The test took place in the atmospheric conditions of such a normal relative humidity as 50% and such a high relative humidity as 80%. In addition, the temperature of the heat roller fixing means was set at 180° C.

The results of the test showed the toner of the present invention enabled the obtaining of a clearly reproduced image with a sufficient image density, whereas control magnetic toner-3, although the image reproduced in the initial stage was good, became blurred as the copyings proceeded in succession, thus ending up in the image of insufficient density. On the other hand, control magnetic toner-4 formed an image lacking in density with much fog in the high humidity.

EXAMPLE 7

The same materials as in Example 6 with the exception that the triiron tetraoxide "Mapico Black BL-500" was eliminated were mixed and dispersed, and the dispersed mixture was added to a solution prepared by dissolving 3.3 parts of polyvinyl alcohol into 230 parts of water put in a 1-liter separable flask, and the contents were heated to 70° C. with stirring by means of a normal stirrer at the rate of 350 r.p.m. to be polymerized over a period of 6 hours to thereby obtain polymer particles with the average particle diameter of 0.2 mm. The product thus obtained was kneaded with triiron tetraoxide "Mapico Black BL-500" (manufactured by Titan Industry Co., Ltd.) in the same ratio as in Example 6 to thereby obtain a lump, which was then coarsedly pulverized and further finely pulverized by a jet mill, and the thus obtained powder body was subjected to a heat treatment by means of a spray drier with its entrance temperature of 350° C. and exit temperature of 50° C., and further was classified by a zigzag classifier (manufactured by Alpine), whereby a magnetic toner-7 of the present invention having the average perticle diameter of 16 microns was obtained.

Comparative Example 5

A polymer was obtained in the same manner as in Example 6 with the exception that the titanium coupling agent isopropyl triisostearoyl titanate "TTS" (manufactured by Ajinomoto Co., Inc.) and the triiron tetraoxide powder "Mapico Black BL-500" (manufactured by Mitsubishi Industry Co., Ltd.) were eliminated, and the thus obtained polymer was kneaded together with titanate coupling agent isopropyl triisostearoyl titanate "TTS" (manufactured by Ajinomoto Co., Inc.) and triiron tetraoxide powder "Mapico Black BL-500" (manufactured by Titan Industry Co., Ltd.) in the same proportion as in Example 6 to thereby obtain a lump, which was pulverized and then subjected to a sphering and classifying treatments, thus obtaining a control magentic toner-5 with the average particle diameter of 16 microns.

Magnetic toner-7 of the present invention and control magnetic toner-5 were allowed to stand for two months and after that, each of them was subjected to copying tests, then magnetic toner-7 formed a reproduced image having an excellent density, while control magnetic toner-5 formed an image with an entirely low and uneven image density and much fog. And besides, there occurred such a trouble that the paper was wound around the heat roller of the fixing means.

EXAMPLE 8

| | |
|---|---|
| Styrene | 70 parts |
| n-butyl methacrylate | 30 parts |
| Carbon Black "Raven 1250" (manufactured by Columbian Carbon) | 5 parts |
| Azobisisobutylonitrile | 3 parts |
| α,ω-polybutadiene glycol "NISSO-PB-1000" (molecular weight 1000, manufactured by Nippon Soda Co., Ltd.) | 10 parts |
| Low molecular weight polypropylene "VISCOL 550P" (manufactured by Sanyo Chemical Industry Co., Ltd.) | 5 parts |
| Titanate coupling agent "PURENAKUTO 9S" (manufactured by Ajinomoto Co., Inc.) | 1 part |

The above materials were mixed and dispersed to produce a polymer composition, which was then added to a 12.5% by weight aqueous polyvinyl alcohol solution in a 2-liter separable flask, and the contents were stirred by means of a TK Homomixer (manufactured by Tokushu Kika Kogyo co., Ltd.) at the rate of 4000 r.p.m. The particle diameter of the dispersed particles after the 30-minute stirring was in the range of from 8 to 15 microns. Afterwards, the temperature of the system was raised to 70° C. to carry out the polymerization reaction over a period of 6 hours with stirring by use of a normal stirrer at the rate of 100 r.p.m. After completion of the polymerization reaction, the resulting solid product was filtered and then dried to thereby obtain a two-component toner of the present invention having the average particle diameter of 13 microns, which was subsequently mixed in the normal manner with an iron powder carrier, thereby obtaining a two-component developer.

A copying test was made on the resulting two-component developer by the use of an electrophotographic copying apparatus "U-Bix V" (manufactured by Konishiroku Photo Industry Co., Ltd.) in the atmospheric conditions of such a normal temperature/normal relative humidity as 20° C./60% and such a high temperature/high relative humidity as 40° C./80%.

The obtained reproduced image had no fog in both atmospheric conditions and was clear with a sufficient image density. The results of the test also showed that no offset phenomenon occurred and the fixation was satisfactory.

Comparative Example 6

A control toner was produced to obtain a two-component developer in the same manner as in Example 8 with the exception that the titanate coupling agent "PURENAKUTO 9S" (manufactured by Ajinomoto Co., Inc.) was not used, and this was used to make a copying test, then the obtained reproduced image had much fog in both atmospheric conditions and low image density.

What is claimed is:

1. A toner composition for electrophotography, comprising particles having a diameter of up to 50 microns, said particles comprising a vinyl polymer obtained by polymerizing a vinyl monomer in the presence of (i) a titanate coupling agent, and (ii) at least one inorganic material.

2. The toner composition of claim 1, wherein said at least one inorganic material is a magnetic material.

3. The toner composition of claim 2, wherein said magnetic material is triiron tetraoxide.

4. The toner composition of claim 1 or 2, wherein said titanate coupling agent is a compound of the formula [I], [II], [III], [IV], or [V]:

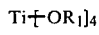

[I]

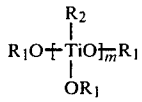

[II]

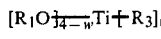

[III]

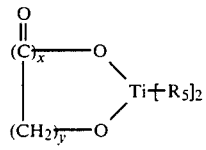

[IV]

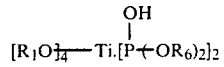

[V]

wherein each $R_1$ is an alkyl group or an aralkyl group having up to 18 carbon atoms, represents $-OR_1$ or $-OOCR_1$, $R_3$ represents $-OOCR_1$, $-SO_3R_1$,

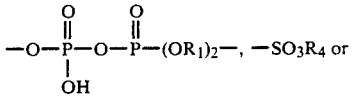

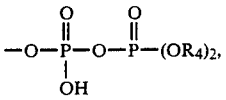

$R_4$ represents an aryl group, $R_5$ represents $R_1$ or $R_3$, $R_6$ represents $R_1$ or an aryl group, m represents 2 to 20, w represents 1 to 3, x represents 0 to 1, and y represents 1 to 3.

5. The toner composition of claim 1 or 2, wherein said vinyl monomer comprises a styrene monomer.

6. The toner composition of claim 1 or 2, further comprising a lower molecular weight polyolefin.

7. The toner composition of claim 6, wherein said lower molecular weight polyolefin has a weight average molecular weight of 1,000–45,000.

8. The toner composition of claim 1 or 2, wherein said polymer is polymerized by a suspension polymerization process.

9. The toner composition of claim 8, wherein said polymer is polymerized in the presence of a suspension stabilizer.

10. The toner composition of claim 1 or 2, wherein the average particle diameter of said toner is 7 to 30 microns.

11. The toner composition of claim 1 or 2 further comprising a coloring agent.

12. The toner composition of claim 1 or 2, wherein said titanate coupling agent is selected from the group consisting of:

$$Ti(OCH(CH_3))_4 \quad (1)$$

$$Ti[OC_4H_9]_4 \quad (2)$$

$$Ti[OCH_2CH(C_2H_5)C_4H_9]_4 \quad (3)$$

$$Ti[OC_{17}H_{35}]_4 \quad (4)$$

$$(CH_3CHO)_2Ti(OC(CH_3)CH_2COCH_3)_2 \quad (5)$$

$$(C_4H_9O)_2Ti[OC_2H_4N(CH_2CH_2OH)_2]_2 \quad (6)$$

$$Ti[OCH_2CH(OH)CHC_3H_7]_4 \quad (7)$$

(8)

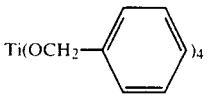

(9)

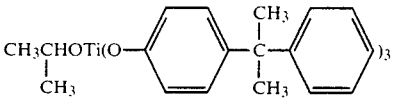

(10)

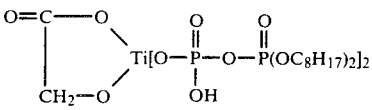

(11)

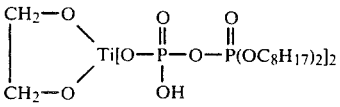

$$(CH_3CHO)_4Ti.[P(OC_8H_{17})_2]_2 \quad (12)$$

$$(C_8H_{17}O)_4Ti.[P(OC_{13}H_{27})_2]_2 \quad (13)$$

(14)

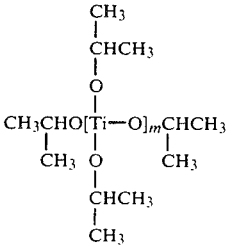

$\bar{m} = 10$ (15)

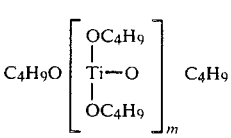

$\bar{m} = 4, 7, 10$

-continued (16)

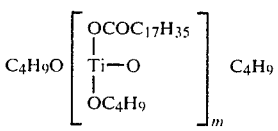

$\bar{m} = 4$ $$(C_{17}H_{35}COO)Ti(OC_4H_9)_3 \quad (17)$$

$$(C_{17}H_{35}COO)_3TiOCH(CH_3) \quad (18)$$

(19)

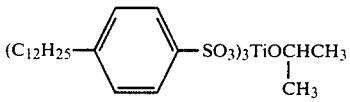

(20)

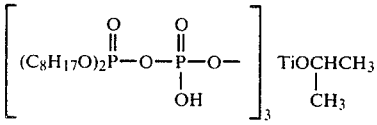

$$(C_7H_{15}COO)_3TiOCH(CH_3) \quad (21)$$

(22)

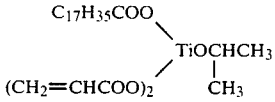

13. The toner composition of claim 4, which contains at least two inorganic materials, one of said inorganic materials being triiron tetraoxide and another of said inorganic materials being a pigment, and wherein said toner particles have an average particle diameter of from 7 to 30 microns.

14. A method for manufacturing toner for electrophotography, which comprises polymerizing a vinyl monomer in the presence of a titanate coupling agent and at least one inorganic material.

15. The method of claim 14, wherein said inorganic material is a magnetic material.

16. The method of claim 14, wherein said titanate coupling agent is a compound of the formula [I], [II], [III], [IV] or [V]:

$$Ti[OR_1]_4 \quad [I]$$

$$R_1O[Ti(R_2)(OR_1)O]_{\bar{m}}R_1 \quad [II]$$

$$[R_1O]_{4-w}Ti[R_3]_w \quad [III]$$

[IV]

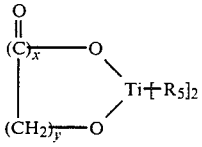

$$[R_1O]_4Ti.[P(OR_6)_2]_2 \quad [V]$$

wherein each $R_1$ is an alkyl group or an aralkyl group containing up to 18 carbon atoms, $R_2$ represents $—OR_1$ or $OOCR_1$, $R_3$ represents $—OOCR_1$, $—SO_3R_1$,

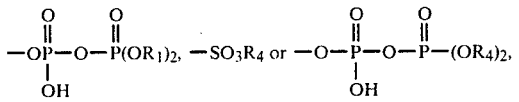

$R_4$ represents an aryl group, $R_5$ represents $R_1$ or $R_3$, $R_6$ represents $R_1$ or an aryl group, m represents 2 to 20, w represents 1 to 3, x represents 0 or 1, and y represents 1 to 3.

17. The method of claim 16, wherein said vinyl monomer comprises a styrene monomer.

* * * * *